US005763734A

United States Patent [19]

Nachtman et al.

[11] Patent Number: 5,763,734

[45] Date of Patent: Jun. 9, 1998

[54] METHOD FOR CONTAINING OR REMOVING CONTAMINANTS FROM A SUBSTRATE

[76] Inventors: Thomas J. Nachtman, 8119 Comanche Trail, Temperance, Mich. 48182; Harold B. Greer, 1125 Waverly Ave., Toledo, Ohio 43607; John H. Hull, 3554 Edgevale Rd., Toledo, Ohio 43606

[21] Appl. No.: 733,133

[22] Filed: Oct. 18, 1996

Related U.S. Application Data

[60] Provisional application No. 60/005,603 Oct. 19, 1995.

[51] Int. Cl. [6] ..... G21F 9/00

[52] U.S. Cl. ..... 388/1; 134/4; 134/42; 427/5; 427/6; 427/156; 976/DIG. 376

[58] Field of Search ..... 588/1; 976/DIG. 376; 134/4, 42; 427/5, 6, 156

[56] References Cited

U.S. PATENT DOCUMENTS

| | | | |
|---|---|---|---|
| 3,440,086 | 4/1969 | Kerns | 117/105.5 |
| 4,379,729 | 4/1983 | Cross | 156/73.6 |
| 4,433,067 | 2/1984 | Rice et al. | 521/51 |
| 4,444,910 | 4/1984 | Rice et al. | 521/51 |
| 4,607,090 | 8/1986 | Dominguez | 528/48 |
| 4,716,210 | 12/1987 | Trummelmeyer et al. | 528/75 |
| 4,960,620 | 10/1990 | House et al. | 427/385.5 |
| 4,996,940 | 3/1991 | Cleary | 118/306 |
| 5,013,813 | 5/1991 | Zimmerman et al. | 528/60 |
| 5,118,728 | 6/1992 | Primeaux | 523/315 |
| 5,124,426 | 6/1992 | Primeaux, II et al. | 528/60 |
| 5,162,388 | 11/1992 | Primeaux, II | 521/159 |
| 5,171,818 | 12/1992 | Wilson | 528/59 |
| 5,189,075 | 2/1993 | Zimmerman et al. | 521/159 |
| 5,205,864 | 4/1993 | Snyder | 106/287.6 |
| 5,218,005 | 6/1993 | Zimmerman et al. | 521/58 |
| 5,250,650 | 10/1993 | Boretzky et al. | 528/67 |
| 5,266,671 | 11/1993 | Primeaux, II | 528/68 |
| 5,405,218 | 4/1995 | Hyde-Smith | 405/303 |
| 5,415,499 | 5/1995 | Hyde-Smith et al. | 405/303 |
| 5,421,906 | 6/1995 | Borah | 134/26 |
| 5,545,794 | 8/1996 | Bray | 588/1 |
| 5,599,871 | 2/1997 | Park | 524/504 |
| 5,616,677 | 4/1997 | Primeaux, II et al. | 528/66 |
| 5,630,785 | 5/1997 | Pridemore et al. | 588/255 |

OTHER PUBLICATIONS

"Potential Uses for Polyurea Spray Elastomers", Texaco Chemical Co., 1990.

Santosusao et al., "RT Curing Polyureas", Rubber & Plastics News, pp. 13–16, Dec. 24, 1990.

"Adhesion Studies for Spray Polyurea Elastomers", Texaco Chemical Co., Sep. 15, 1992.

"Polyurea Spray Technology Information", Texaco Chemical Co., 1988.

"Spray Polyurea . . . Elastomer for the Polyurethane Industry", D.J. Primeaux II, Oct. 1989.

"Spray Polyurea Elastomers Offer Performance Advantages", D.J. Primeaux II, Jun. 1991.

"Processing Polyurea Elastomers Systems", Texaco Chemical Co., 1992.

"InstaCote–ML", Master–Lee Decon Services, Jan. 1995.

"Irradiation of Insta–Cote Spray Elastomer System", Oct. 1995.

Newby, B.J. et al; Decontamination of Protective Coating Following a Loss of Coolant Accident, Chemical Abstracts, vol. 68, 1968, 31128J.

Schmitt, B.F.; Testing the Ease of Decontamination of Coatings, 76–Nuclear Technology, vol. 71, 1969: 118736p.

Berger, N.; Decontaminability of Surface Coatings, 42–Coatings, Inks, and Related Products, 42–Coatings, vol. 74, 1971, 14228v.

Demtroeder, P. et al; Encapsulation of Radioactively Contaminated Components, Chemical Abstracts, vol. 96, 1982, 76310d.

Thornton, E.; Paint Decontamination Kinetics, 71–Nuclear Technology vol. 100, 1984, 181846g.

DeTassigny, C; Development and Use of a Method for Coating of Contaminated Metallic Wastes by Thermosetting Resins, Chemical Abstracts, vol. 103, 1985: 28997z.

Lubkiewiez, J., Decontaminability of Organic Protective Coatings for the Nuclear Industry, Chemical Abstracts, vol. 106, 1987, 24520c.

DeTassigny, C. et al; Immobilization of Contamination by Using Polymer Coatings on Large–Volume Radioactive Waste in View of their Storage, 71–Nuclear Technology, vol. 113, 1990: 239928x.

Neupert, D. et al; Method for the Sealing and Decontamination of Radioactive and Radioactively Contaminated Components and Materials, 71–Nuclear Technology, vol. 98, 1983: 115519s.

*Primary Examiner*—Ngoclan Mai

*Attorney, Agent, or Firm*—MacMillan, Sobanski & Todd

[57] ABSTRACT

A method for containing or removing contamination from a substrate includes applying a material such as a polyurea elastomer to the contaminated substrate. Preferably, the material sets in less than about 1 hour and is substantially unaffected by exposure to radiation. The contaminants can be contained or shielded on the substrate by the material to reduce exposure to the contaminants. In one preferred embodiment, this invention relates to the encapsulation of objects or surfaces to shield persons in the area from contamination. Alternatively, the material can be removed from the substrate to remove contaminants. Preferably, the material provides a Decontamination Factor of at least about 10. In another preferred embodiment, the material is applied hot to the contaminated substrate to increase its effectiveness in removing contaminants. The present method can also prevent contamination of an uncontaminated substrate. The invention also provides a decontamination material including a polyurea elastomer and a wax.

17 Claims, 2 Drawing Sheets

METHOD FOR CONTAINING OR REMOVING CONTAMINANTS FROM A SUBSTRATE

CROSS-REFERENCE TO RELATED APPLICATION

This application claims priority based on provisional application Ser. No. 60/005,603, filed Oct. 19, 1995.

BACKGROUND OF THE INVENTION

This invention relates in general to the containment or removal of contaminants from substrates. Such contaminants can include radioactive materials, asbestos, lead, and other hazardous materials. The contaminants can be contained or shielded on the substrate to reduce exposure to the contaminants. Alternatively, the substrate can be decontaminated to remove the contaminants. In one preferred embodiment, this invention relates to the encapsulation of objects or surfaces to shield persons in the area from contamination. In another preferred embodiment, this invention relates to the decontamination of nuclear containment vessels.

Problems frequently arise in the handling or disposal of contaminated objects or materials, and in working in areas having surfaces which have been contaminated by radiation or hazardous materials. The objects or surfaces can sometimes be decontaminated, but it is often difficult and impractical to provide effective decontamination. Hazardous waste materials can be buried in containers for disposal, but the containers may degrade and leak contamination after a period of time. Thus, it would be desirable to provide an improved method for containing or encapsulating radioactive and hazardous contaminants.

Nuclear power plants are usually shut down for routine maintenance about every 18 months. At that time, substrates such as the surfaces of nuclear containment vessels are treated to decontaminate them, for example the floor, walls, ladders, bolts and other surfaces. The conventional treatment method is to apply a latex compound (emulsion) to the surface, allow it to dry, and then pull it from the surface to remove the contaminants. Unfortunately, the conventional method suffers from several drawbacks. The latex compound can take days to dry and can thus prolong the shutdown time. The latex compound is also sometimes difficult to pull off the surface after it dries. Further, the latex compound is not totally effective in removing the contaminants and reducing radioactive exposure to an industry accepted level. Thus, it would be desirable to provide an improved method for removing radioactive and hazardous contaminants from a substrate.

SUMMARY OF THE INVENTION

Figure 1:
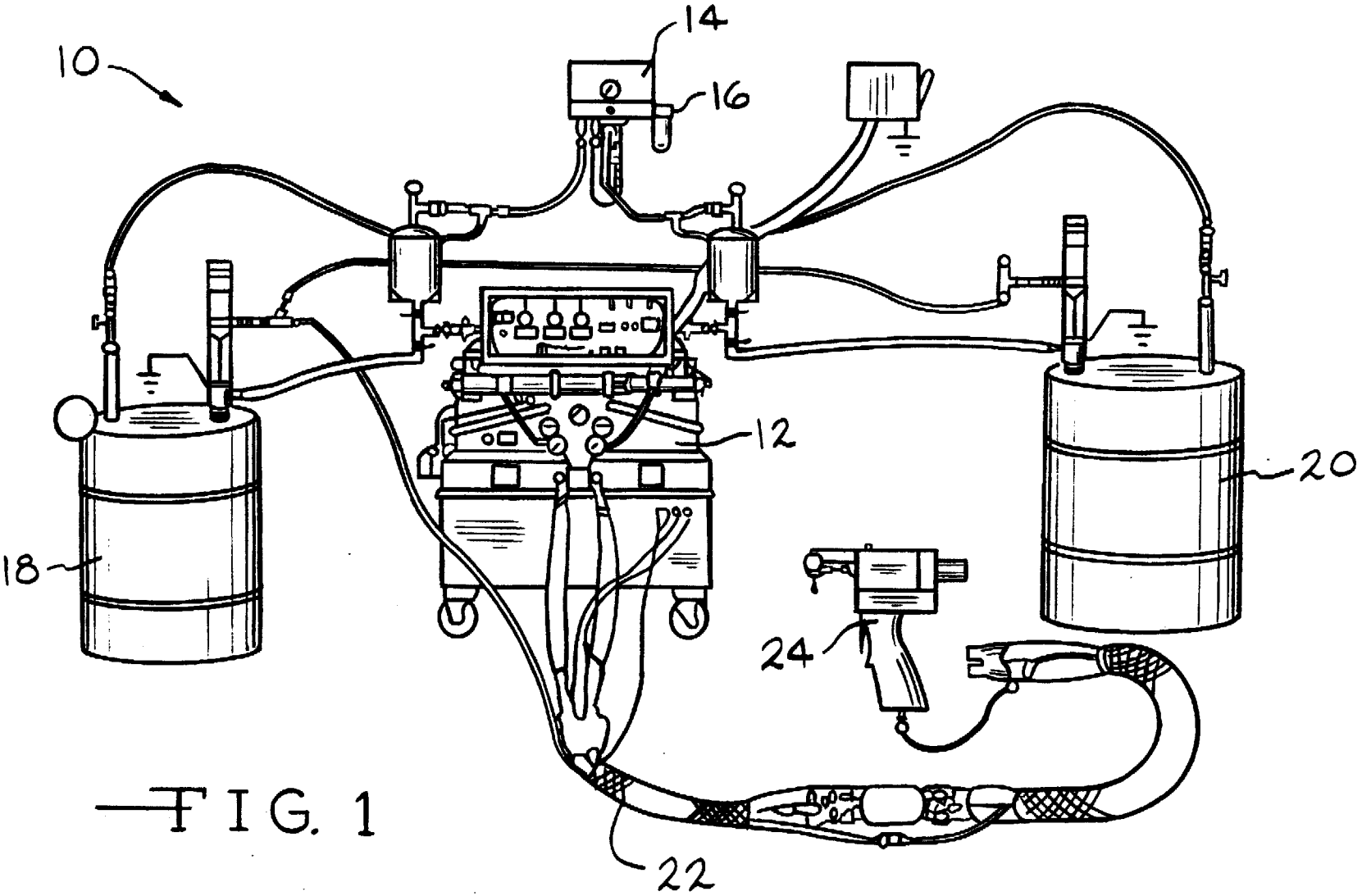
FIG. 1 is a schematic view of a spray apparatus for applying a polyurea elastomer according to the method of this invention.

The present invention provides a method for containing or removing contamination from a substrate. A material such as a polyurea elastomer is applied to the contaminated substrate. Preferably, the material sets in less than about 1 hour and is substantially unaffected by exposure to radiation. The contaminants can be contained or shielded on the substrate by the material to reduce exposure to the contaminants. Alternatively, the material can be removed from the substrate to remove contaminants. Preferably, the material provides a Decontamination Factor of at least about 10. In a preferred embodiment, the material is applied hot to the contaminated substrate to increase its effectiveness in removing contaminants. The present method can also prevent contamination of an uncontaminated substrate. The invention also provides a decontamination material including a polyurea elastomer and a wax.

DETAILED DESCRIPTION OF THE PREFERRED EMBODIMENTS

A first embodiment of this invention is a method for containing or shielding contamination on a substrate. The method comprises applying a decontamination material to a contaminated substrate. For example, the substrate can be completely coated or encapsulated by the decontamination material to shield the surrounding area from contamination. The contaminants can include radioactive materials, asbestos, lead, and other hazardous materials. The substrate can be metal, glass or vitrified material, concrete, wood, a thermoset or thermoplastic material, or another contaminated surface. The decontamination material can be selected from materials including polyurea elastomers, polyurethanes, polyamides, and any isocyanate plural component system.

For example, equipment or tools may be contaminated and may be required for further use. Often such objects are difficult and impractical to effectively decontaminate. By the method of this invention, such objects can be encapsulated to shield the contamination so that they can be used by workers. If the walls or floors of an area are contaminated, they can be coated with the decontamination material as a shield to make it safe for workers in the area. Advantageously, the polyurea elastomers for use in the invention are quick setting and can be washed easily. The polyurea elastomers can also be easily removed from the substrate to decontaminate the substrate, as will be discussed below. Another use of this invention is to encapsulate containers of radioactive or hazardous materials to make them safer for long term disposal or storage.

A preferred decontamination material for use in the invention is a polyurea elastomer. Suitable polyurea elastomers are described in U.S. Pat. No. 5,415,499 assigned to Foamseal, Inc. (incorporated by reference herein). The polyurea elastomer is prepared by mixing and reacting an isocyanate-terminated compound or polymer with an amine compound containing at least two reactive amine groups and then essentially immediately applying the resultant reacting mixture to the contaminated substrate. Preferably the mixing of the two reactants is effected directly with a spray gun used to apply the mixture (i.e., impingement mixing), as will be described below.

The isocyanate-terminated compounds or polymers have at least two terminal isocyanate groups and may be either aliphatic or aromatic in nature. The isocyanate-terminated compounds have mean functionality of about 2 to 3.2 and contain about 15 to 35 weight percent isocyanate groups. Preferred isocyanate-terminated compounds are based on, or derived from, methylene diphenyl diisocyanate (MDI). Preferred isocyanate-terminated compounds are the monomers or polymers of the general formula I

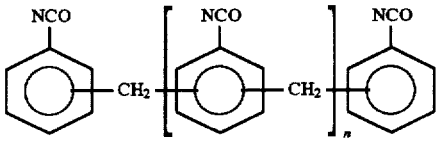

where n is an integer from 0 to about 10 and preferably from 0 to about 4. The isocyanate-terminated compound I is methylene diphenyl diisocyanate when n is 0 and is a polymeric methylene diphenyl diisocyanate when n is greater than 0. Mixtures of the compounds I can also be used. In fact, a mixture containing compound I where n equals 0, is one preferred isocyanate-terminated compound. Preferably compound I is, when n equals 0, a mixture of the 4,4'-methylene diphenyl diisocyanate and the 2,4'-methylene diphenyl diisocyanate isomers. Often, this mixture will contain a small amount of the 2,2'-isomer (i.e., 2,2'methylene diphenyl diisocyanate). Compound I with n greater than or equal to 1 is a linear polymer. As those skilled in the art will realize, branched polymers can also be used where methylene phenyl isocyanate groups are attached directly to one or both of the phenyl rings in the methylene diphenyl diisocyanate structure. Mixtures of such linear and branched polymers can also be used. Other preferred isocyanate-terminated compounds are quasi-prepolymers of the general formulas II and III:

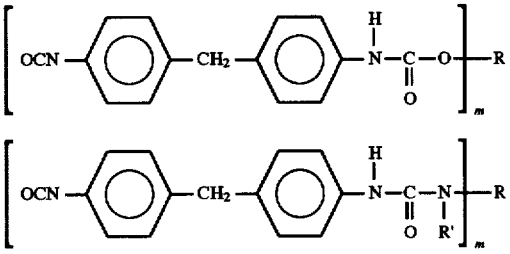

where m is equal to 2 or 3, R' is a hydrogen or an aliphatic radical (e.g., methyl or ethyl radical), and R represents an aliphatic polyether. The polymer II is an isocyanate-terminated quasi-prepolymer prepared by reacting a polymer as defined in formula I with a dihydroxyl-terminated or a trihydroxyl-terminated polyol. The polymer III is an iso cyanate-terminated quasi-prepolymer prepared by reacting a polymer as defined in formula I with a diamine-terminated or a triamine-terminated polyether. Generally, quasi-prepolymers of general formula II are preferred. Especially preferred polyols are the aliphatic polyether polyols. For example, reacting a hydroxyl-terminated polyether (HO~OH) with methylene diphenyl diisocyanate yields an isocyanate-terminated prepolymer as illustrated in the following equation:

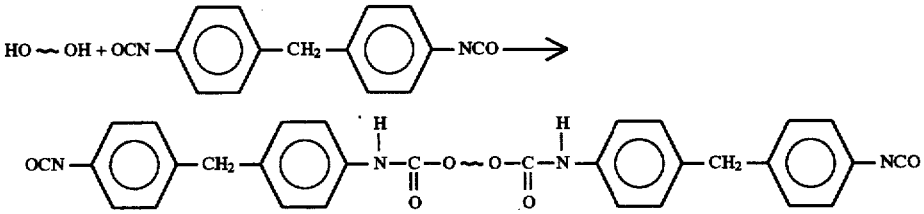

where~represents the aliphatic polyether portion. Similarly, a polyether diamine could be reacted with methylene diphenyl diisocyanate. Examples of such aliphatic polyether groups include the following:

$$-CH_2\underset{\underset{R''}{|}}{CH}+OCH_2\underset{\underset{R''}{|}}{CH}\underset{x}{+}OCH_2\underset{\underset{R''}{|}}{CH}-,$$

$$-CH_2CH_2CH_2+OCH_2CH_2CH_2\underset{x}{+}OCH_2CH_2CH_2-, \text{ and}$$

$$-CH_2CH_2CH_2CH_2+OCH_2CH_2CH_2CH_2+OCH_2CH_2CH_2CH_2-$$

where each R" is independently a hydrogen or a methyl radical. Thus, these polyether compounds are based on the polymerization of ethylene oxides, propylene oxides, butylene oxides, and the like. Preferably, x has an average value such that the molecular weight of the polyol portion is in the range of about 500 to 6000, and more preferably in the range of about 500 to 2500.

Isocyanate-terminated polymers suitable for use in the present invention are generally available commercially. Examples of such commercially available materials include methylene diphenyl diisocyanate (MDI) such as Rubinate X 9009 and Rubinate X 9272 (both 4,4'-methylene diphenyl diisocyanate, differing somewhat in molecular weight and crosslinking) from ICI Polyurethanes Group, West Deptford, N.J.; other isocyanates such as PAP194 from Dow Chemical Company, MRS Series isocyanates from Miles, Inc., Mondur ML from Miles, Inc.; uretonimine modified methylene diphenyl diisocyanates such as Mondur CD from Miles, Inc., Isonate 143L from Dow Chemical Company and LF-168 from ICI Polyurethanes; quasi-prepolymers prepared from methylene diphenyl diisocyanates such as Mondur PF from Miles, Inc., Isonate 181 from Dow Chemical Company, and LF-179 from ICI Americas, Inc. Other commercially available isocyanate-terminated polymers may also be used. Examples of polyether polyols useful in preparing quasi-prepolymers of the present invention include PolyG 20-56, PolyG 30-28, PolyG 85-36, PolyG 85-29, PolyG 76-120, PolyG 55-28, and PolyG 55-56 from Olin Corporation. Some preferred polyether polyols are the polypropylene oxide polyether diols and ethylene oxide-capped polyether triols. Similar polyether polyols from other suppliers may also be used to prepare the quasi-prepolymers. Mixtures of suitable isocyanate-terminated compounds can be used and are often preferred.

As noted above, the polyurea elastomer for use in the invention is prepared by mixing and reacting an isocyanate-terminated compound or polymer with an amine compound containing at least two reactive amine groups wherein the mixing and reacting occurs immediately before the application to the contaminated substrate. The amine compound can be aliphatic or aromatic. The reactive amine can be a primary or a secondary amine. The amine-terminated compounds generally have a mean functionality of about 2.0 to 3.0 and an average molecular weight of about 150 to 6000. Preferred amine compounds include amine-terminated polymers and aliphatic or aromatic diamines. Preferred amine-terminated polymers are the polyoxyalkyleneamines having primary amino groups attached to the terminus of polyether backbones (i.e., polyether amines). Examples of preferred aliphatic amine-terminated polymers include polymers of general formula IV $$H_2N-CH_2\underset{\underset{R''}{|}}{CH}+OCH_2\underset{\underset{R''}{|}}{CH}\underset{x}{+}OCH_2\underset{\underset{R''}{|}}{CH}-NH_2$$

where each R" is independently hydrogen or a methyl radical. Preferably, R" is a methyl radical and the average value of x is in the range of about 2 to 105 which corresponds to an average molecular weight of about 230 to 6000. An example of such an aliphatic amine-terminated polymer is the Jeffamine D-2000 amine-terminated polypropylene glycol from Texaco Chemical Co. where in the above formula IV, R" is a methyl group, x has an average value of about 33, and the molecular weight is about 2000.

Triamine polymers can also be used. Examples of preferred aliphatic triamine-terminated polymers include polymers of general formula V $$\begin{array}{l} CH_2+OCH_2CHR")_a-NH_2 \\ | \\ CH+OCH_2CHR")_b-NH_2 \\ | \\ CH_2+OCH_2CHR")_c-NH_2 \end{array}$$

where R" is hydrogen or a methyl radical. Preferably R" is a methyl radical and a, b, and c are independently in the range of about 0 to 100 and such that the average molecular weight is in the range of from about 260 to about 6000. Specific examples of such triamine-terminated polymers include Jeffamine T-3000 (average molecular weight of 3000 and containing about 50 moles of polypropylene oxide) and Jeffamine T-5000 (average molecular weight of about 5000 and containing about 85 moles of polypropylene oxide) from Texaco Chemical Company.

Examples of suitable aliphatic amines include bis (paraaminocyclohexyl)methane and mixed polycycloaliphafic amines (both commercially available from Air Products and Chemicals, Inc.). Examples of suitable aromatic amines include 3,5-diethyltoluene-2,4-diamine, 3,5-diethyltoluene-2,6-diamine, and mixtures thereof (commercially available as Ethacure 100 from Ethyl Corporation); para-di(N-alkyl)amine benzene (commercially available as Unilink 4100 from UOP); and 4,4'-methylene diphenyl di(N-alkyl)amine (commercially available as Unilink 4200 from UOP), as well as Unilink 8100, and Unilink 8130 from UOP. Oligomeric diamines (i.e., polytetramethyleneoxide di-p-aminobenzoate) such as Polamine-650, Polamine-1000, and Polamine-2000 from Air Products and Chemicals, Inc. can also be used. Mixtures of suitable amine compounds can be used and are often preferred.

The polyurea elastomer is preferably made by combining the isocyanate-terminated compound and the amine compound in approximately a 1:1 volume ratio. Preferably, the processing index is from about 1.05 to about 1.10. However, the ratio of the two components can be varied depending on the desired properties of the decontamination material.

Various additives can be included in the polyurea elastomer. For example, organic or inorganic dyes or colorants can be added. Other additives, including light stabilizers, UV absorbers, anti-oxidants, thermal stabilizers, adhesion promoters, and other processing aids or enhancers, can also be employed. Foaming agents can be added to the polyurea elastomer, or the material can be foamed by other means such as a foaming apparatus.

Other preferred polyurea elastomers are described in the following patents assigned to Texaco Chemical Co.: 5,189,075, 5,124,426, 5,013,813, 4,607,090, 4,444,910, 4,433,067 and 4,379,729 (all incorporated by reference herein) These patents also disclose chain extenders which can optionally be formulations.

Advantageously, the polyurea elastomer very rapidly sets up (by crosslinking), typically taking less than a minute to set up whereas a latex compound can take days to dry. The polyurea elastomer creates a very durable, abrasion-resistant, attractive surface on the substrate. The surface is a plastic that is much stronger than a typical latex compound. It offers years of protection to shield a contaminated substrate. The polyurea elastomer can be modified to make it softer or harder depending on the intended use. A latex compound, on the other hand, is always relatively soft. The polyurea elastomer is a stable, non-leachable material that is insensitive to water and resistant to most chemicals. It contains no volatile organic compounds.

The polyurea elastomer can effectively contain the contaminants on a substrate with a single coating. The thickness of the coating can vary widely depending on the type of contamination. A coating having a thickness of as little as 0.02 inch has been found to be effective in shielding different types of radiation (described in Example 3 below). The coating can have a thickness of ⅛ inch to ¼ inch or more depending on the application.

The decontamination material can be applied to a substrate by any method such as spraying, rolling or brushing. Preferably, the material is applied by spraying. The polyurea elastomer is well suited for spraying, and can be easily sprayed on sloped, vertical or horizontal surfaces. If desired, the substrate can first be treated with a primer such as an aqueous solution of silane. Other primers are disclosed in U.S. Pat. No. 5,415,499. The polyurea elastomer typically turns into a gel about two seconds after exiting the spray apparatus and sets up in about 20–30 seconds. However, the formulation can also be adjusted so that the polyurea elastomer remains a liquid for several minutes before gelling. The setting time can also be adjusted.

Referring now to the drawings, there is illustrated in FIG. 1 a preferred spray apparatus 10 for applying a two-component decontamination material such as the polyurea elastomer. The spray apparatus includes a pump/control unit 12. The pump/control unit allows control of the relative amounts, temperatures and pressures of the two components. An air dryer 14 includes an inlet 16 connected to a main air supply. A first drum 18 contains a first component of the decontamination material, such as the isocyanate-terminated compound of the polyurea elastomer. A second drum 20 contains a second component of the decontamination material, such as the amine compound of the polyurea elastomer. The air and first and second components are separately fed through a heated hose 22 to a spray gun 24 where they are combined to form a spray of decontamination material. This is better illustrated in FIG. 2. It can be seen that the air 26, the first component 28, and the second component 30 are fed through separate hoses and combined in the spray gun 24 to form a spray 32. The spray is applied directly to the contaminated surface. The temperature of the polyurea elastomer during spraying is generally in the range of about 140° to 200° F., and preferably in the range of about 160° F. to 180° F.

The preferred commercial brand of spray apparatus shown in FIG. 1 is a Model GX7 spray gun and a Model FF-3500 pump/control unit, both manufactured by Gusmer Corp. The spray apparatus has an adjustable output between ½ lb/min and 15 lbs/min, and a maximum pressure rating of 3500 psi. It is capable of spraying materials having a viscosity between 250 cps and 1500 cps. Another preferred pump/control unit is a Gusmer Model H-2000. Any other commercially available spray apparatus suitable for spraying a two-component decontamination material may also be used.

A second embodiment of this invention is a method for removing contamination from a substrate, comprising applying a decontamination material to a contaminated substrate, and then removing the decontamination material containing contaminants from the contaminated substrate. Usually the decontamination material is applied by spraying, allowed to set up, and then removed by pulling it off the substrate. When the polyurea elastomer is applied and then removed to decontaminate the substrate, generally the thickness of the coating is from about ⅛ inch to about ¼ inch.

Advantageously, the preferred polyurea elastomer of this invention has a high tensile strength so that it remains together instead of pulling into pieces upon removal. The tensile strength of the polyurea elastomer is greater than its coefficient of adhesion on the surface of the contaminated substrate, so that it can be easily removed from the substrate. Grips can be formed in the decontamination material as it is applied to facilitate its removal.

The decontamination material of this invention is highly effective in removing contaminated particles from a substrate, and in encapsulating the contaminated particles in the interior of the decontamination material. As a result, when the contaminated particles are radioactive particles, there is less exposure of workers to radiation. The treated substrate is cleaner and thus has a longer useful life. For disposal, the decontamination material can be shredded and is fully burnable with low emissions.

A third embodiment of this invention is a preferred method for removing contamination from a substrate, comprising applying a hot decontamination material to a contaminated substrate, allowing the decontamination material to cool, and then removing the decontamination material containing contaminants from the contaminated substrate. It has been discovered that the decontamination material is more effective when it is applied hot onto the substrate. For removing contamination from a metal substrate, preferably the decontamination material is applied at a temperature from about 100° F. to about 500° F., more preferably from about 100° F. to about 250° F., more preferably from about 140° F. to about 200° F., and most preferably from about 160° F. to about 180° F. The spray apparatus illustrated in FIGS. 1 and 2 can be used to heat the decontamination material, or it can be heated by other means. Preferably, the decontamination material is allowed to cool to below about 750° F. before removal from the substrate.

It is believed that applying a hot decontamination material is more effective for several reasons. The surface of the substrate very rapidly heats and swells upon contact with the hot decontamination material. This is believed to open up the microscopic pores of the substrate and loosen up the contaminant particles for easier removal from the substrate. Additionally, the contaminants swell with heat which allows for easier removal. The decontamination material in its curing stage draws the contaminants out from inside the substrate, not just the surface of the substrate When the decontamination material is swelled with heat, in conjunction with surface activity it results in enhanced absorption of the contaminants and more uniform application on the surface.

Any type of decontamination material can be used in this third embodiment of the invention, including the materials described above, and also including other materials such as other elastomers, the conventional latex compound described above, and other emulsions. The preferred polyurea elastomer has good high temperature properties, being stable up to about 350° F. or higher.

The method of the present invention is highly effective for removing contamination from a substrate. The effectiveness of a decontamination method can be measured by calculating a Decontamination Factor (DF). An initial contamination survey is performed to record the existing contamination level on a particular substrate. Then the substrate is decontaminated. Finally, a post-decontamination survey is performed to assess the remaining contamination on the substrate. The Decontamination Factor is calculated as the initial contamination divided by the final contamination. For example, a predecontamination survey of 500,000 dpm and a post-decontamination survey of 200,000 dpm would provide a DF of 500,000/200,000=2.5. The method of this invention provides a Decontamination Factor of from about 10 to about 800 depending on the substrate. This is more effective than a conventional latex compound which usually produces significantly lower Decontamination Factors.

Thus, it is seen that the method of this invention provides at least two major advantages over a conventional latex decontamination compound. First, the present method uses a decontamination material that sets or dries much more quickly than the latex compound. The decontamination material sets or dries in less than about 1 hour, preferably less than about 10 minutes, more preferably less than about 3 minutes, and most preferably not longer than about 1 minute. Preferably, the decontamination material is a plastic material that sets quickly, and more preferably a thermoset material. Second, the present method uses a decontamination material that is more effective than the latex compound in removing contaminants from a substrate. The decontamination material provides a Decontamination Factor of at least about 10, preferably at least about 20, more preferably at least about 50, and most preferably at least about 100. In its broad aspect, the present method utilizes any decontamination material which sets or dries in less than about 1 hour and which provides a Decontamination Factor of at least about 10.

The polyurea elastomer has been found to be more effective in blocking gamma radiation than most plastic coatings of the same thickness. A polyurea elastomer coating having a thickness of 3/32 inch is capable of blocking from about 3% to about 5% of the gamma radiation. Most plastics are not as good at blocking gamma radiation. The polyurea elastomer is also effective in blocking almost 100% of the beta radiation. It has been found that a polyurea coating having a thickness from about 1/32 inch to about 1 inch is most effective in blocking radiation. Thicknesses greater than about 1 inch provide diminishing returns in blocking radiation.

A fourth embodiment of this invention is a modified composition for decontaminating a substrate. The composition comprises, by weight, from about 80% to about 99.5% of a decontamination material and from about 0.5% to about 20% of a wax, and preferably from about 90% to about 98% of a decontamination material and from about 2% to about 10% of a wax. The amount of wax can be adjusted as long as the desired properties of the decontamination material are retained. Preferably the composition also contains a surfactant to enhance dispersal of the wax. The preferred wax is Carnuba wax, and the preferred decontamination material is the polyurea elastomer. When the composition is heated for application to a substrate, the wax is melted and well dispersed but it does not dissolve in the polyurea elastomer. The melting point of the wax is about 170° F., the same temperature preferred for heating the composition. Then when the composition is sprayed onto the substrate, the wax rapidly cools and does not react with the polyurea elastomer. It forms very fine spherical particles of wax dispersed in the polyurea elastomer.

It has been discovered that addition of the wax to the decontamination material greatly increases ease of removal of the composition from the substrate after it sets up. The composition containing the wax will easily release off any substrate. It is believed that the composition also has improved ability to remove contaminants from a substrate. The wax is believed to remove more contaminant particles and increase their movement to the interior of the composition.

A fifth embodiment of this invention is a method for preventing contamination of a substrate, comprising applying a decontamination material to an uncontaminated substrate. The decontamination material, such as those described above, thereby prevents contamination of the substrate. For example, the decontamination material can be applied to the interior of a clean nuclear containment vessel before contaminated water is poured into the vessel. When the plant is shut down, the water can be drained and the decontamination material removed. The containment vessel remains clean. Then a new coating of decontamination material can be applied before additional use of the containment vessel. The decontamination material can also protect against sludges, soils, and other contaminants and hazardous materials. This embodiment of the invention could be used in different applications such as cleanup sites, nuclear power sites, nuclear weapons manufacturing sites, nuclear storage sites, or hazardous waste sites.

EXAMPLE 1

A preferred hard (stiff) version of the polyurea elastomer is especially suited for applying as a protective coating on a contaminated substrate. This hard version is a 1:1 volume mixture (index 1.05) of an isocyanate portion and an amine portion as follows:

Isocyanate Portion:

60% 4,4'-methylene diphenyl diisocyanate (MDI) (Rubinate X 9009)

40% polypropylene glycol (average molecular weight of 2000)

Amine Portion:

25% 3,5-diethyltoluene-2,4-diamine and 3,5-diethyltoluene-2,6-diamine (Ethacure 100)

32% triamine-terminated polymers (Jeffamine T-3000)

32% amine-terminated polypropylene glycol (Jeffamine D-2000)

11% 4,4'-methylene diphenyl di(N-alkyl)amine (Unilink 4200)

Figure 2:
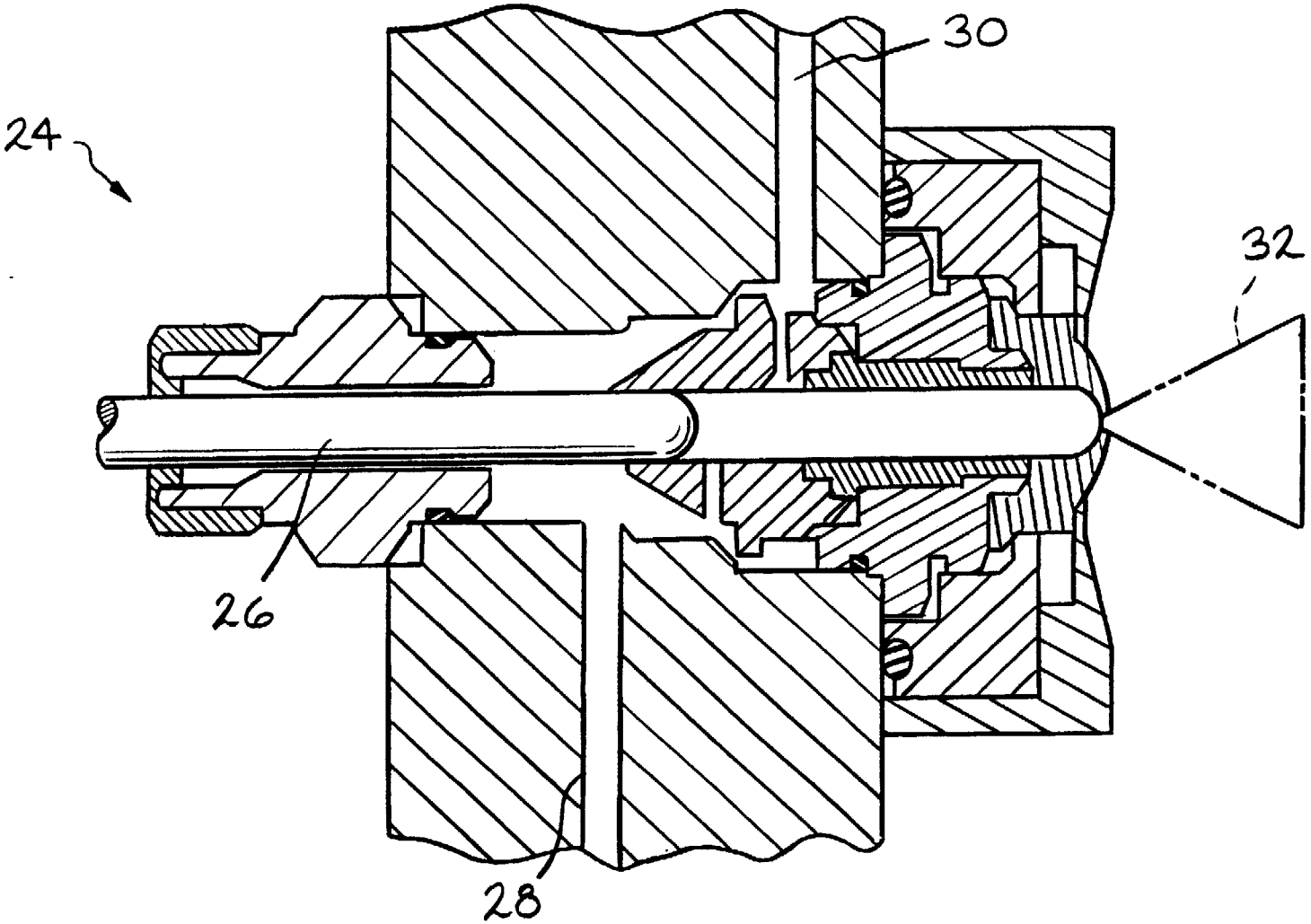
FIG. 2 is a schematic view of a portion of a spray gun of the spray apparatus shown in FIG. 1.

The isocyanate portion and amine portion are mixed and sprayed onto a contaminated substrate using the apparatus illustrated in FIGS. 1 and 2. The coating of polyurea elastomer sets very rapidly and contains or shields the contamination on the substrate. The polyurea elastomer has the following physical properties:

| | |
|---|---|
| Elongation, % | 185 |
| Tensile Strength, psi | 1845 |
| Shore D Hardness | |
| 0 sec | 52 |
| 10 sec | 45 |
| Impact, Notched, ft-lbs/inch | 4.9 |
| Flexural Modulus, psi | |
| 158° F. | 20810 |
| 77° F. | 38010 |
| −20° F. | 100910 |
| Impact embrittlement testing ASTM D 746 | −36° F. to −40° F. |
| Spraying gel time, sec. | 2 |
| UV resistance | good |
| Elongation to break (adv.) | 106 mm |
| lbs to break (adv.) | 156 |
| Chemical resistance (ASTM D 1239) Benzene | Solubility low to nil |
| Breakthrough test for benzene (elastomer did not allow transmission of benzene) | |
| Surface at 20 sec. | Dry |

The chemical resistance of the hard version of the polyurea elastomer was evaluated using a chemical spot in which the polyurea elastomer was in contact with the chemical for a period of 7 days at 77° F. The polyurea elastomer showed no effect to acetone, antifreeze, DEA-85%, diesel fuel, ethylene glycol, gasoline, washer fluid, heptane, hydraulic oil, jet fuel, kerosene, methanol, propylene glycol, N-100/water (Huntsman), N-40/water (Surfonic), Solvent 140 (aromatic triethylene glycol), TEG, and Vm&p Naptha. It showed slight effect to brake fluid, butanol, and sulfuric acid 10%. It showed moderate effect to propylene carbonate. Treatment with DMF and sulfuric acid conc. is not recommended.

EXAMPLE 2

A preferred soft (rubber-like) version of the polyurea elastomer is a 1:1 volume blend (index 1.05) of isocyanate portion and an amine portion as follows:

Isocyanate Portion:

57% 4,4'-methylene diphenyl diisocyanate (MDI) (Rubinate X 9009)

38% 4,4'-methylene diphenyl diisocyanate (MDI) (Rubinate X 9272)

5% propylene carbonate

Amine Portion:

80% amine-terminated polypropylene glycol (Jeffamine D-2000)

20% 3,5-diethyltoluene-2,4-diamine and 3,5-diethyltoluene-2,6-diamine (Ethacure 100)

The isocyanate portion and amine portion are mixed and sprayed onto a contaminated substrate such as a nuclear containment vessel using the apparatus illustrated in FIGS. 1 and 2. The coating of polyurea elastomer has a thickness of about ⅛ inch to ¼ inch. The polyurea elastomer sets very rapidly, usually in less than about one minute. After it sets, the polyurea elastomer is removed from the substrate to decontaminate the substrate. This soft version of the polyurea elastomer is very easy to remove because it is pliable and has no negative relief.

EXAMPLE 3

Twenty-one test samples of the hard version of the polyurea elastomer described in Example 1 were subjected to various irradiation tests at the University of Michigan Nuclear Reactor Laboratory. The samples had three different thicknesses: 0.022 inch, 0.040 inch and 0.067 inch. As shown in a Certificate of Compliance issued by the University of Michigan Nuclear Reactor Laboratory, within the range of tested exposures, the samples were generally unaffected by exposure to gamma or neutron radiation.

More specifically, eighteen samples were subjected to exposures of between $5.01\times10^6$ and $3\times10^8$ rad of gamma radiation. Another three samples were subjected to combined gamma and neutron radiation, resulting in exposures of over $2\times10^8$ rad of gamma radiation, over $8\times10^{16}$ n/cm$^2$ of thermal neutron radiation, and $1.5\times10^{16}$ n/cm$^2$ of fast neutron radiation. The physical properties of the samples were then tested.

None of the irradiated samples showed any visible signs of physical change, deterioration or any other effects that would impair their intended function. When comparing pre-exposure and post-exposure measurements, only minor changes in sample length, width, thickness, weight, or hardness were noted, with no clearly discernible trend relating the variations in these parameters to radiation exposure.

The shielding characteristics of the polyurea elastomer were measured. The polyurea elastomer was found to have an attenuation characteristic of 5.4886 in$^{-1}$ (a tenth thickness of 0.4191 inches) for thermal neutrons (0.06 ev). The gamma radiation shielding characteristics of the polyurea elastomer were tested against two sources of gamma radiation. The polyurea elastomer was found to have an attenuation characteristic of 0.1374 in$-^{1}$ (a tenth thickness of 16.7494 inches) for the 661 keV gamma radiation from Cesium-137, and have an attenuation characteristic of 0.0744 in$^{-1}$ (a tenth thickness of 30.914 inches) for the 1173 keV and 1331 keV gamma radiation from Cobalt 60. Electron attenuation was measured, and the polyurea elastomer was found to have an attenuation characteristic of 19.1502 in$^{-1}$ (a tenth thickness of 0.1201 inches) for the electron emissions (average of 695 keV) from Phosphorus-32.

Finally, the polyurea elastomer was tested for post-irradiation radioactivity after a twenty-seven day decay period. No significant quantities of any radionuclides were found, with only trace quantities of Mercury-203, Iron-59, and Cobalt-60 identified. The polyurea elastomer subjected to both gamma and neutron irradiation had average activities of only 0.00057 to 0.002791 microcuries/gram.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method for containing radioactive contaminants on a substrate, comprising applying a polyurea elastomer to a radioactive contaminated substrate.

2. A method for removing contamination from a substrate, comprising applying a polyurea elastomer to a contaminated substrate and then removing the material to remove contaminants from the substrate.

3. The method defined in claim 2 wherein the polyurea elastomer sets in less than about 1 hour.

4. The method defined in claim 2 wherein the polyurea elastomer provides a Decontamination Factor of at least about 10.

5. The method defined in claim 2 wherein the polymer elastomer has a tensile strength greater than its coefficient of adhesion on the substrate.

6. A method for removing contamination from a substrate, comprising applying a material at a temperature of at least about 100° F. to a contaminated substrate, and then removing the material to remove contaminants from the substrate, wherein the material is selected from the group consisting of polyurea elastomers, other isocyanate plural component systems, polyurethanes, polyamides, latex, and mixtures thereof.

7. The method defined in claim 6 wherein the material is a polyurea elastomer.

8. The method defined in claim 6 wherein the material sets in less than about 1 hour.

9. The method defined in claim 6 wherein the material provides a Decontamination Factor of at least about 10.

10. The method defined in claim 6 wherein the material has a tensile strength greater than its coefficient of adhesion on the substrate.

11. The method defined in claim 1 wherein the polyurea elastomer is applied as a coating having a thickness from about 1/32 inch to about 1 inch.

12. The method defined in claim 1 wherein the polyurea elastomer is applied as a coating which blocks at least about 3% of gamma radiation emitted by the radioactive contaminants.

13. The method defined in claim 2 wherein the contaminants are radioactive contaminants.

14. The method defined in claim 2 wherein the polyurea elastomer is applied as a coating having a thickness from about 1/8 inch to about 1/4 inch.

15. The method defined in claim 6 wherein the contaminants are radioactive contaminants.

16. The method defined in claim 7 wherein the polyurea elastomer is applied as a coating having a thickness from about 1/8 inch to about 1/4 inch.

17. The method defined in claim 6 wherein the material is applied at a temperature from about 140° F. to about 500° F.

* * * * *